United States Patent [19]

Howe et al.

[11] 4,044,083

[45] Aug. 23, 1977

[54] METHOD OF MAKING PLASTIC SKI

[75] Inventors: John G. Howe; William L. Schmidt, both of Boulder, Colo.

[73] Assignee: AMF Incorporated, White Plains, N.Y.

[21] Appl. No.: 598,196

[22] Filed: July 23, 1975

Related U.S. Application Data

[62] Division of Ser. No. 410,825, Oct. 29, 1973, Pat. No. 3,930,658.

[51] Int. Cl.[2] ..... B29D 27/04

[52] U.S. Cl. ..... 264/45.3; 264/46.5; 264/46.7; 264/261; 264/320; 264/321; 264/DIG. 6; 280/610; 428/71; 428/120; 428/184; 428/310; 428/314

[58] Field of Search ..... 264/46.5, 46.7, 45.3, 264/DIG. 6; 280/11.13 L

[56] References Cited

U.S. PATENT DOCUMENTS

| | | | |
|---|---|---|---|
| 2,744,042 | 5/1956 | Pace | 264/46.5 |
| 3,050,427 | 8/1962 | Slayter et al. | 264/DIG. 6 |
| 3,233,576 | 2/1966 | Voelker | 264/46.7 X |
| 3,402,520 | 9/1968 | Lee et al. | 264/46.5 X |
| 3,446,692 | 5/1969 | Turnbull | 264/46.7 X |
| 3,510,392 | 5/1970 | D'Eustachio et al. | 264/DIG. 6 |
| 3,549,468 | 12/1970 | Messineo et al. | 264/DIG. 6 |
| 3,815,215 | 6/1974 | Medawar | 264/267 X |
| 3,816,573 | 6/1974 | Hashimoto et al. | 264/46.5 |
| 3,834,962 | 9/1974 | Strumbos | 264/46.5 X |
| 3,970,324 | 7/1976 | Howat | 428/71 X |

FOREIGN PATENT DOCUMENTS

| | | | |
|---|---|---|---|
| 2,026,824 | 6/1970 | Germany | 280/11.13 L |
| 364,443 | 9/1962 | Switzerland | 280/11.13 L |
| 1,173,199 | 12/1969 | United Kingdom | 280/11.13 L |

*Primary Examiner*—Philip Anderson
*Attorney, Agent, or Firm*—George W. Price; Walter Lewis

[57] ABSTRACT

A snow ski having a plastic foam core formed in situ between preformed top and bottom subassemblies.

3 Claims, 2 Drawing Figures

METHOD OF MAKING PLASTIC SKI

This is a division of our application Ser. No. 410,825, filed Oct. 29, 1973 and now U.S. Pat. No. 3,930,638.

This invention relates to a method of making an aluminum and plastic sandwich ski structure.

It is an object of this invention to provide a low cost ski and method of making the same which is adaptable to a high degree of automation.

Briefly, in the invention the core of the ski is formed in situ between preformed top and bottom ski subassemblies. In the preferred form of the invention the core is a rigid plastic foam material. The top and bottom subassemblies are positioned in a mold and retained spaced from each other to the desired core thickness by an intervening corrugated paper member or the like while liquid plastic foam material previously positioned in the mold between the two preformed subassemblies is rising and foaming itself into the rigid plastic foam material core of desired thickness.

Figure 1:
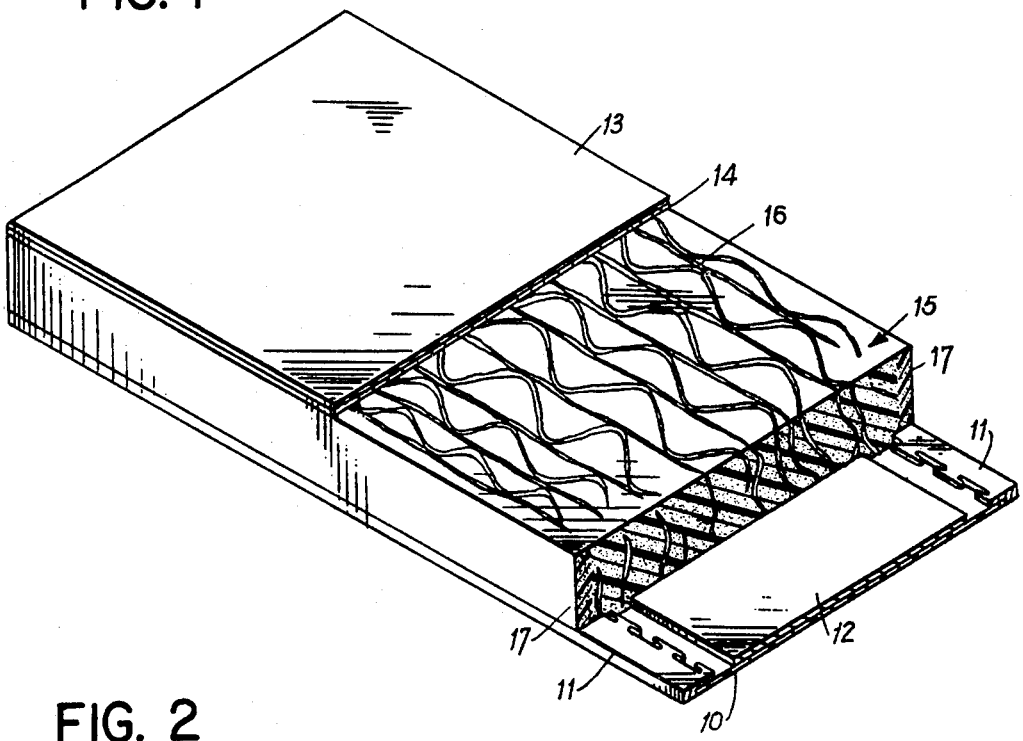
Figure 2:
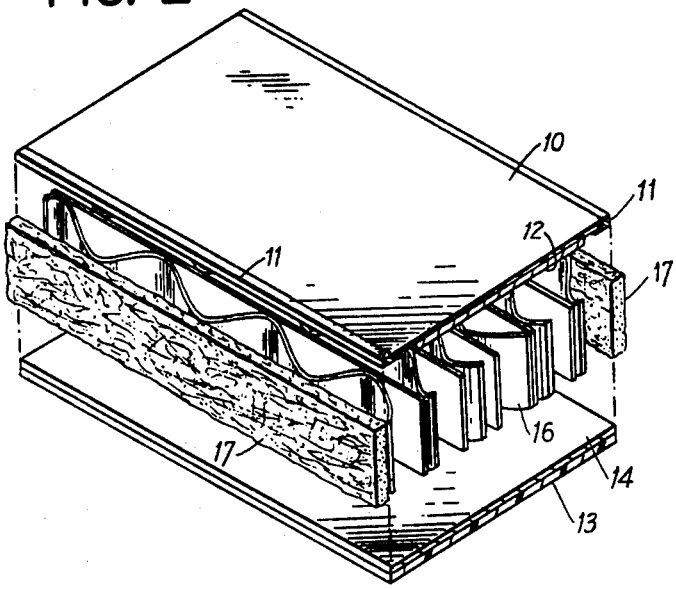

The invention is best understood by considering the following detailed description and attached sheet of drawing in which FIG. 1 is a broken away cross-section of the ski, and FIG. 2 is an illustration of the positioning of the various parts thereof in the mold during fabrication thereof. As shown in FIG. 2, when the ski is in the mold, it is inverted, but like reference numerals are used in the two Figures to indicate like parts.

Referring first to FIG. 1, the ski comprises a bottom subassembly, a top subassembly, and an intervening core. The bottom subassembly comprises a plastic bottom running surface 10, a pair of steel edges 11, and a strip of aluminum 12. These three parts are preconnected to each other by a suitable adhesive into a preformed bottom subassembly.

The aluminum strip 12 is spaced from the steel edges 11. In other words, it has no direct connection therewith. This provides the advantage that the physical characteristics of the ski can be readily varied by making slight variations in the width of the aluminum strip 12. That is to say, the change is made at strip 12, rather than in the shape of the mold, or in the design, as would be the case if strip 12 had direct connection with the steel edges 11.

The top subassembly, which is also preformed, comprises a top plastic surface 13 and an underlying aluminum strip 14 adhered thereto. The core between the top (13, 14) and bottom (10, 11, 12) subassemblies comprises a reinforced rigid plastic foam material member 15. This is formed in situ or "foamed-in-place" from a foamable thermosetting resin material between the top and bottom subassemblies when they are set in the mold to their proper spacing for the desired core thickness in a manner which will be explained shortly in connection with a detailed description of the method of the invention.

Briefly, however, the core 15 has an embedded corrugated paper laminate member 16 constructed from narrow strips of paper which are oriented perpendicular to the top and bottom subassemblies. This corrugated member 16 is slightly oversize in thickness as compared to the desired final thickness of the core 15. When the mold is closed, the corrugated member 16 is crushed slightly. This causes the corrugated member to forcibly bear against the top and bottom subassemblies to keep them firmly seated in their proper positions in the mold. This is quite important, since the ski is several feet long, and if all the parts are not properly seated in the mold, the ski will be defective structurally and appearancewise.

The corrugated member 16 is wide enough to have some of its paper strips bear against the steel edges 11. This is advantageous since the steel edges also are several feet long and if they are not held in position in the mold, they may buckle.

In order to prevent the paper strips of the corrugated member 16 from being visible through the outermost side surfaces of the core, a pair of strips of compressible, highly porous plastic foam material 17 are positioned along opposite sides of the member 16. The liquid plastic foam material or foamable thermosetting resin material which is employed to make the rigid plastic foam core 15, rises, foams, and generates internal pressure while the mold is closed. Since the corrugated member 16 is open mesh, and the strips 17, porous, the plastic foam material will permeate both members 16 and 17 and fill the space between the top and bottom subassemblies. That is to say, the liquid foam resin will also work through the members 17 to provide a visually smooth finish along the outermost sides of the core.

Turning now to FIG. 2, in the method the top subassembly 13, 14 is first placed in the mold inverted position. Then the liquid plastic foam material is deposited in the mold and spread over the inverted top subassembly 13, 14. Then the corrugated member 16 is inserted into the mold in the liquid plastic foam material. Actually, when the corrugated member 16 is placed in the mold cavity it has the two porous strips 17 adhered thereto. Then the bottom subassembly 10, 11, 12 is placed over the preformed core insert subassembly 16, 17. Then the mold is closed. When the mold is closed, the corrugated member 16 is crushed slightly and the pair of strips 17 compressed. Thus, the core strip insert subassembly 16, 17 is frangible or compressible so that it serves as a positive spacer means to hold the top and bottom subassemblies in proper position in the mold and spaced to the desired core thickness. Also, as mentioned heretofore, the paper strips of the corrugated member 16 bear against the steel edges 11 to prevent them from buckling, and the pair of strips 17 prevent the paper strips from showing through the sides of the core 15.

The whole cycle takes only about 15 minutes and is conducted at a mold temperature of about 130° F. Since the temperatures are relatively low, the parts can be handled immediately. That is to say, the mold does not have to be cooled down and then reheated for the next cycle. When the skis are taken out of the mold, they are finished products except for cleaning them up cosmetically, such as removing the flash of the core material. Since the cycle is short and to the largest extent possible preformed subassemblies are used, the ski and its method lends itself to a high degree of automation, and a very high rate of production is attainable as compared to that of prior ski constructions and methods of making the same.

When utilizing mold forming methods of manufacture, one key to success is keeping all the parts seated in proper position in the mold in order to get good fidelity with the mold. If this is accomplished, and it is in the invention, then it is possible to obtain excellent results in terms of good physical and visual characteristics on a consistant reproducible basis.

In the invention when the liquid plastic foam material is converting itself into the rigid finished core 15, it generates about 30 psi of internal pressure. This is advantageous since this internal pressure ensures that the core 15 completely fills the space between the top and bottom subassemblies and has good fidelity with the mold. Also, such internal pressure purges air from the mold and drives off the excess core material as core flash.

In the invention, the preformed top subassembly 13, 14 will have been milled along its sides to the desired ski contour. The same applies to the bottom running surface 10 of the bottom subassembly 10, 11, 12 prior to affixing the steel edges 11 thereto.

In one successful embodiment of the invention, glass micro balloon filled polyurethane foam resin was used for the core 15. Also, the facing sides of the top and bottom subassemblies were coated with polyurethane adhesive. The core edge strips 17 were adhered to the paper honeycomb member 15 and comprised highly porous open cell compressible polyurethane foam. ABS plastic sheet was used for the top plastic surface 13, and polyethylene sheet was used for the bottom running surface 10. All these materials are readily available on the marketplace along with instructions for their use, so therefore these materials per se do not comprise part of our invention.

A typical foam comprised a three part $C0_2$ blown polyurethane foam comprising 100 parts by weight of a prepolymer formed from Chempol (Freeman Corporation) 13-1727 resin and 32–160l isocyanate with a water and catalyst mixture having a free rise density of 10 to 10.5 pounds per cubic foot and a cream time of 35 to 45 seconds, and 9.3 parts by weight 3M (Minnesota Mining and Mfg. Co.) B25B glass bubbles of 0.23 nominal specific gravity. However, the glass micro balloons could be as high as 20% by weight, and bubbles other than glass, such as phenolic could be used. Also, though, the micro balloons or bubbles could be omitted so long as the final ski core after foaming was between about 20 to 50 pounds per cubic foot.

It is to be particularly noted that the frangible or compressible open mesh or porous core insert strip means preassembly 16, 17 is not for the purpose of adding structural strength to the ski, as in the case of prior art skis utilizing aluminum honeycomb core inserts or the like. In fact, in the invention, the core insert strip means 16, 17 is incapable of strengthening the core to any significant degree. Rather, the core insert is intentionally selected to be readily frangible, compressible, or crushable so that the mold can be readily closed, without damaging any of the other ski components, but still have sufficient physical form to serve as a positive spacer means in the closed mold until such time as the in situ formed core assumes a sufficient form to do this of itself. For this reason, the core insert strip means 16, 17 is not critical except as to its ability to serve as an interim spacer means. That is to say, for the corrugation 16 to space the top and bottom subassemblies to the desired thickness of the core 15 and for the strips 17 to space the corrugation 16 inwardly so that the paper strips thereof do not show through the sides of the core 15. After the core 15 is set, the spacer means 16, 17 has no further utility since its job of assisting the in situ formed core 15 to take its proper shape is done. For this reason, the invention is not necessarily restricted to the particular illustrated form of the spacer means 16, 17. It is possible to use other spacer means which will "give" under mold closure while still having sufficient shape to operate as a positive spacer. That is to say, to provide a force of about 5 to 500 psi against the subassemblies to hold them in place in the mold during foaming of the core. However, the particular form 16, 17 of the spacer means has much to commend itself. Both parts 16 and 17 are very low in cost, readily obtainable and easily worked or handled. It is easy to cut them to shape or size. Also, due to their frangible or compressible nature, it is not necessary to hold close dimensions or tolerances. All that is necessary is that the corrugation 16 be slightly oversize in thickness or depth, that is to say, in the dimension running perpendicular to the planes of the top and bottom subassemblies. The corrugation 16 is also slightly oversize in its width or transverse dimension. Since it is only paper, it is readily squeezed or fitted into the mold while still ensuring that some of its paper strips cover the entire area of the top and bottom subassemblies including bearing against the steel edges 11.

What we claim to be our invention is:

1. A method of making aluminum and plastic foamed sandwich ski structure comprising the steps of preforming top and bottom ski subassemblies, laying said top subassembly in the bottom of a mold, spreading depositing and a foamable thermosetting resin material in liquid form over said top subassembly, inserting a slightly oversized corrugated paper laminate member having strips of compressible highly porous foam material on opposite sides thereof into said foamable thermosetting resin over said laminated member and strip members closing said mold to partially crush said laminate member and compress said strip members whereby the same bears against said top and bottom subassemblies to retain them seated in said mold to the desired thickness of a core between said top and bottom subassemblies, and retaining said mold closed until said liquid foamable thermosetting resin material foams, cures and unites to the preform to form a rigid foamed plastic sandwich ski structure.

2. In a method as in claim 1, wherein said top subassembly comprises a top plastic running surface and a first strip of aluminum adhered to the underside of said top plastic running surface, said top subassembly being inverted in said mold, said bottom subassembly comprising a plastic bottom running surface having a pair of steel edges adhered to opposite side edges thereof and a second strip of aluminum adhered to the top surface of said bottom running surface, said bottom subassembly being inverted in said mold, and said corrugated laminate is constructed from narrow strips of paper oriented perpendiculr to said top and bottom subassemblies, said corrugated member having a thickness in excess of said desired core thickness whereby the same is partially crushed when said mold is closed while still bearing against said top and bottom subassemblies to space them from each other to said desired core thickness and said foamable thermosetting resin material has glass microballoons added thereto.

3. In a method as in claim 2, wherein said second strip of aluminum has a width less than the spacing between the innermost portions of said steel edges and is spaced therefrom and without direct connection therewith whereby the physical characteristics of said ski structure are adapted to be varied by making small variations in the width of said second aluminum strip, and said corrugated member having a width sufficient to cause some of said narrow strips of paper to bear against said steel edges to prevent buckling of the same, and wherein said strips of compressible porous plastic foam material positioned along opposite sides of said corrugated laminate member space the paper strips thereof inwardly of the sides of said mold.

* * * * *